United States Patent [19]
Cain et al.

[11] Patent Number: 4,475,989
[45] Date of Patent: Oct. 9, 1984

[54] INSULATING CHARGING HOLE COVER

[75] Inventors: George R. Cain; Stanley T. Sczerba, both of Pittsburgh, Pa.

[73] Assignee: Raymond Kaiser Engineers Inc., Oakland, Calif.

[21] Appl. No.: 481,561

[22] Filed: Mar. 28, 1983

Related U.S. Application Data

[63] Continuation-in-part of Ser. No. 334,655, Dec. 28, 1981, abandoned.

[51] Int. Cl.³ ..... C10B 25/24; C10B 43/14
[52] U.S. Cl. ..... 202/251; 202/267 R
[58] Field of Search ..... 202/242, 245, 247, 248, 202/250, 251, 267 R; 49/463; 432/250; 126/220; 266/271; 414/164

[56] References Cited

U.S. PATENT DOCUMENTS

| | | | |
|---|---|---|---|
| 2,203,698 | 6/1940 | Schmidt | 202/250 |
| 2,920,017 | 1/1960 | Limberg | 202/250 |
| 3,689,369 | 9/1972 | Tucker | 202/251 |
| 3,900,369 | 8/1975 | Irie et al. | 202/247 |
| 4,033,827 | 7/1977 | White | 202/248 |
| 4,186,056 | 1/1980 | Muller et al. | 202/269 |
| 4,368,104 | 1/1983 | Winter | 202/250 |
| 4,406,619 | 9/1983 | Oldengott | 202/250 |

FOREIGN PATENT DOCUMENTS

| | | | |
|---|---|---|---|
| 523263 | 4/1931 | Fed. Rep. of Germany | 202/251 |
| 2062826 | 5/1981 | United Kingdom | 266/271 |

OTHER PUBLICATIONS

Hackman et al.; "RIBTEC Steel Fiber in Refractories, Application to the Steel Industry"; Tech. Paper; Am. Cer. Soc.; 1977.
Hackman et al.; "RIBTEC Steel Fiber in Refractories, Engineering, Steel Fiber Reinforced Refractories"; Tech. Paper; Am. Cer. Soc.; 5-1977.
Hackman; "Selection of Steel Fiber Alloy Spells Success for Refractory Castables"; Brick & Clay Record; 5-1981.

*Primary Examiner*—Bradley Garris
*Attorney, Agent, or Firm*—Flehr, Hohbach, Test, Albritton & Herbert

[57] ABSTRACT

A coke oven charging hole cover which includes a cylindrical wall section and a lower horizontal layer of a cast-in-place castable refractory material which is relatively dense and which contains a random dispersion of fine stainless steel fibers or similar fibers. A layer of an insulating material such as insulation board or a lightweight castable insulating refractory material is superimposed over the dense refractory material to enhance the overall insulating effect while avoiding damage due to carbon impregnation. A means for holding the refractory in the wall section such as a wire mesh which is fixed to the wall section and cast into the lower layer of the refractory is also provided.

12 Claims, 6 Drawing Figures

INSULATING CHARGING HOLE COVER

CROSS REFERENCE TO RELATED APPLICATIONS

This is a continuation-in-part of application Ser. No. 334,655, filed Dec. 28, 1981 now abandoned.

BACKGROUND OF THE INVENTION

1. Field of the Invention

The present invention deals with coke ovens and, in particular, with coke oven charging hole covers.

2. Description of the Prior Art

Coke ovens are conventionally filled with coal in preparation for the coking process through a plurality of charging holes located on the battery top. The removable covers for these charging holes have generally consisted of a single cast iron plate which rests on a frame surrounding the charging hole so as to form a peripheral gravity seal around the charging hole where the cover contacts the frame. These plates, however, are known to reach such high temperatures during the coking process that they may tend to warp, and if such warping does occur they may no longer form a gas tight seal with the charging hole frame. The escape of pollutants from inside the oven may, therefore, result. Furthermore, because heat is conducted more efficiently through these cast iron charging hole covers than through other sections of the oven roof, it is believed that this cast iron construction may be responsible for the occurrence of undersirable concentrations of heat directly above the covers. Various suggestions have been made for alleviating the above mentioned problems. U.S. Pat. No. 3,900,369, for example, proposes that a cover be constructed by bolting or otherwise fixing a preformed refractory plate section below an iron cover top section. While this cover would appear to reduce heat flow from inside the coke oven, it may, under certain circumstances, be preferable not to incur the costs involved in manufacturing a specially shaped, preformed refractory plate and fixing it to the iron cover. In particular, it is deemed advantageous from a cost perspective to use cast-in-place castable refractories in charging hole covers. It has been found, however, that conventional castable refractories may often not be sufficiently durable to be suitable for this use. Furthermore, even if a preformed refractory plate were used on a charging hole cover, such a charging hole cover might be subject to damage as it is continually removed from then replaced over the charging hole because of the relative brittleness of its refractory plate element. It is, therefore, the object of the present invention to provide a comparatively flexible, monolithic insulating charging hole cover which may be manufactured with relative ease and which does not require the production of any costly special refractory shapes.

SUMMARY OF THE INVENTION

The present invention is a charging hole cover which is comprised of a cylindrical wall which has a cover plate fixed to its upper terminal end and which is filled with a castable refractory insulating material which is preferably reinforced with fine stainless steel fibers. At the lower terminal end of the cylindrical wall there is a means for retaining the refractory in position, and a layer of material having superior insulating properties is interposed between the castable refractory and the cover plate. In another embodiment, an upper layer of refractory material is substituted for the central portion of the cover plate, and in still another embodiment a ferrous metal grate is cast into this upper refractory layer to make the cover magnetically liftable.

BRIEF DESCRIPTION OF THE DRAWINGS

The present invention is further described in the accompanying drawings in which.

DETAILED DESCRIPTION

Figure 1:
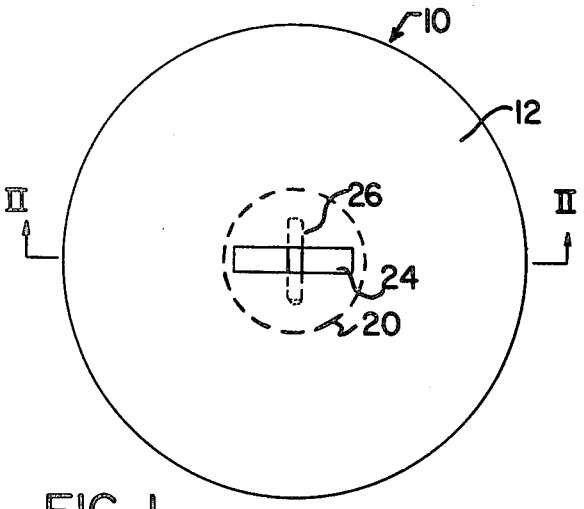
FIG. 1 is a plan view of a charging hole cover illustrating certain features of the present invention.
Figure 2:
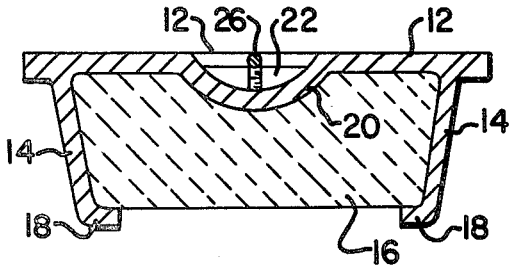
FIG. 2 is a cross sectional view of the charging hole cover of the present invention taken through line II-II in FIG. 1.

A charging hole cover illustrating certain features of the present invention is shown in FIGS. 1 and 2. The cover is shown generally at numeral 10. This cover consists of a circular plate section 12 which is attached to the upper end of a generally cylindrical wall section 14. The wall section 14 is filled with an insulating castable refractory material 16. At the lower end of the wall section 14 there is a peripheral crimp 18 which retains the refractory material 16 in position. Preferably, the refractory material 16 is a refractory and metal composite and, in particular, a refractory matrix containing a random dispersion of fine steel stainless fibers of approximately one inch in length. Suitable steel fibers for inclusion in this matrix are trademarked or otherwise designated as RIBTEC 310 and are available from the Ribbon Technology Corporation of Canal Winchester, Ohio. These fibers provide flexibility to an otherwise generally brittle refractory system, and, along with the taper of the wall section 14 and the crimp 18, these fibers also help retain the refractory material within the wall section 14.

A suitable castable refractory for use in the cover 10 is sold by the General Refractories Company under the trademark LITE CAST ® 30. This dry castable refractory is first mixed with three percent by volume of the RIBTEC 310 fibers. A minimum quantity of water is added to attain the desired plasticity for placement of the castable refractory in the inverted and attached plate section 12 and wall section 14. After this wet castable refractory has been placed in the inverted and attached plate section 12 and wall section 14, it may be satisfactorily dried by bringing its temperature up to 130° F. at the rate of 50° F. per hour. This temperature is maintained for one hour for each inch of thickness. At the rate of 50° F. per hour the temperature is then elevated to 600° F. and held at that temperature for one hour for each inch of thickness. Then at the rate of 100° F. per hour, the temperature should be brought up to 1,000° F. This heating should be continuous and uninterruped, and if excessive steaming should occur the firing rate should not be increased until the steam subsides.

The cover 10 is preferably magnetically lifted, but it may also be manually lifted with a hook. It will be seen from FIGS. 1 and 2 that a concave plate attachment 20 (shown in broken lines in FIG. 1) is fixed below the upper plate 12 so as to form a hook receiving space 22. A hook may be inserted into this hook receiving space through a slot 24 so as to engage an arcuate bar 26 (partially shown in broken lines in FIG. 1). This arcuate bar is attached at its ends to the concave attachment.

Figure 3:
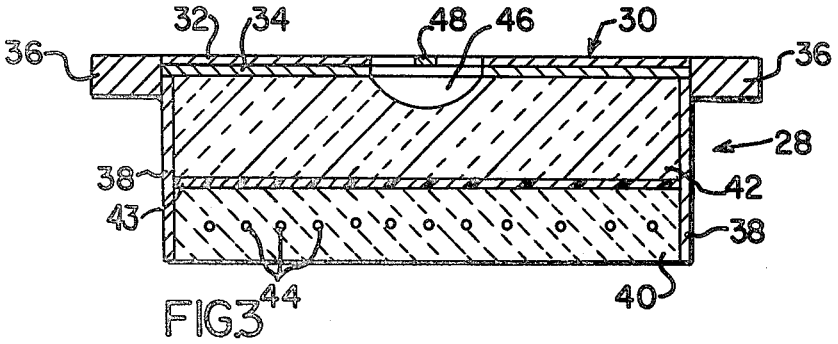
FIG. 3 is a view in vertical section of a charging hole cover representing a preferred embodiment of the present invention.

A preferred embodiment of the present invention is represented by the charging hole cover shown generally at numeral 28 in FIG. 3. The cover 28 consists of an upper lid 30 which is comprised of a steel plate 32 superimposed on a second steel plate 34. Peripherally surrounding the lid 30, there is a steel lip 36. The cover 28 also includes a stainless steel cylindrical wall section 38 which is filled with a layer of dense insulating fiber reinforced refractory 40 and a layer of less dense insulating board 42. The fibers used in the refractory 40 are of the RIBTEC 310 kind described above in connection with the cover 10. The insulating board 42 may be of a type sold by the Johns-Mansville Corporation under the designation Type 103 and the trademark CERA FORM®. It will be appreciated that the addition of the insulating board 42 to the cover enhances the overall insulating ability of the cover, but that such a material could probably not be used in this cover alone since it is subject to impregnation and consequential degradation by carbon particles found inside the charging hole. Since the dense refractory 40 resists carbon impregnation, it may be used to shield the insulating board and permit its interior use in the cover. A plastic liner 43 is emplaced between the refractory 40 and the insulating board 42. A stainless steel plate or foil may also be substituted for the plastic liner 43. It is believed that such a plate or foil would tend to reflect radiant heat downwardly back into the charging hole. Welded to the cylindrical wall 38 there is a wire mesh as at 44, which helps retain the refactory 40 in the cover. It will be understood that the refractory may also be adequately held in the cylindrical wall section by means of a lower terminal crimp on the wall section as is shown at 18 in FIG. 1 and/or by means of a downward and inward taper of the cylindrical wall section as is also shown in FIG. 1. Hence, a wire mesh fixed to the cylindrical wall, a lower terminal crimp on the cylindrical wall section or a downward and inward taper of the wall or any combination of two or more of these elements is considered to be a suitable means for retaining the fiber reinforced castable refractory material inside the cylindrical wall section. The cover 28 is preferably lifted magnetically, but it will also be observed that it is equipped with a hook receiving space 46 and a hook engaging bar 48 so as to facilitate its lifting by manual means. After the insulating board 42 has been emplaced in the cylindrical wall 38, it is covered with the plastic liner 43. The castable refractory is then mixed as was described above and the cylindrical walls are partially filled to the level of the wire mesh. After the refractory has been curred in the manner described above, the mesh is welded to the cylindrical wall. The cylindrical wall is then filled with mixed refractory which is subsequently also cured in the manner described above. It will also be understood that the mesh may be welded to the cylindrical wall section before any wet castable refractory is emplaced in the cylindrical wall section, and that after the mesh has been fixed to the wall section the wall section may then be completely filled with wet castable refractory which is then cured.

Figure 4:
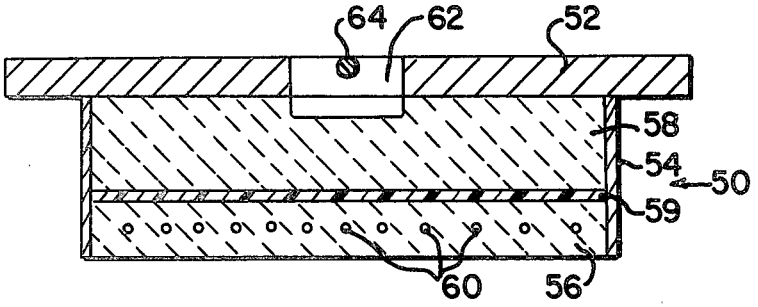
FIG. 4 is a view in vertical section of a charging hole cover representing a second embodiment of the present invention.

Referring to FIG. 4, a cover 50 representing a second embodiment of the present invention is illustrated. This cover has a steel lid 52 which is welded to a steel cylindrical wall 54 which is, itself, filled with a layer of dense fiber reinforced insulating castable refractory 56 and a layer of lightweight castable refractory 58. Preferred fibers for reinforcement are RIBTEC 310 steel fibers. A lightweight castable refractory which is preferred for use in this cover is sold by the General Refractories Company under the trademark or designation LITE CAST® 50 LI. It will be appreciated that this lightweight castable refractory conducts heat less readily than does the denser castable refractory, but that it is also more susceptible to carbon impregnation than the more dense refractory. Hence the use of adjoining layers of these refractories allows for an enhanced insulating effect while still preventing damage due to carbon impregnation. The lightweight castable refractory 58 is not fiber reinforced, and there is a plastic liner 59 between the two layers of refractory. A stainless steel plate or foil may be substituted for the plastic liner 59. A wire mesh 60 is also welded to the cylindrical wall 54 to help retain the refractory layers therein. The light weight refractory is cured and covered with the plastic liner before the denser castable refractory is emplaced in the cylindrical walls. The cover 50 is preferably magnetically lifted, but it may also be lifted manually by means of its hook receiving space 62 and hook engaging bar 64.

Figure 5:
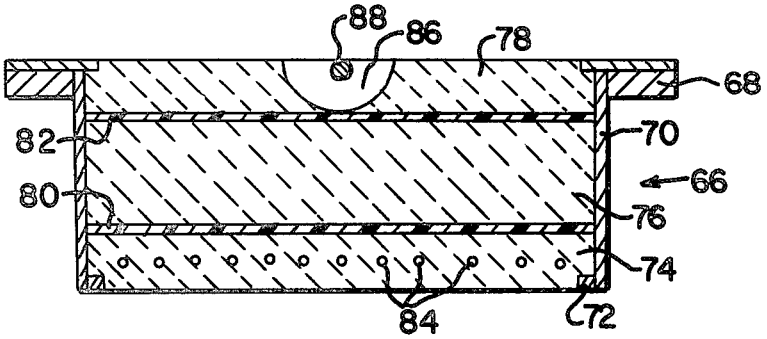
FIG. 5 is a view in vertical section of a charging hole cover representing a third embodiment of the present invention.

A cover representing a third embodiment of the present invention is shown in FIG. 5 generally at numeral 66. This cover 66 has a steel lip 68 and a cylindrical wall 70 with a lower shoulder ring 72. It is filled with a lower layer of dense fiber reinforced insulating castable refractory 74, an intermediate layer of lightweight castable refractory 76 and an upper layer of dense fiber reinforced castable refractory 78. Between these layers of refractory are plastic liners 80 and 82. Stainless steel plates or foils may be substituted for the plastic liners 80 and 81. Welded to the cylindrical wall 70 there is a wire mesh as at 84. The cover 66 is preferably vacuum lifted but it may also be manually lifted by means of hook receiving space 86 and hook engaging bar 88.

Figure 6:
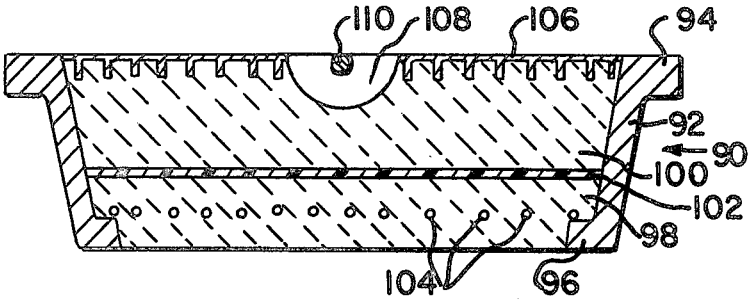
FIG. 6 is a view in vertical section of a charging hole cover representing a fourth embodiment of the present invention.

Referring to FIG. 6 there is illustrated still another embodiment of the present invention, a cover generally illustrated at numeral 90 has a generally cylindrical tapered cast iron side wall 92 which is characterized by an upper lip 94 and a lower shoulder ring 96. Cover 90 is filled with a layer of dense fiber reinforced insulating refractory material 98 and a layer of lightweight insulating castable refractory material 100. Interposed between these two refractory layers is a plastic liner 102. Additionally, a wire mesh 104 is welded to the wall 92 and cast into the refractory 98 to retain the refractory in the cover. A sufficient amount of a ferrous metal material such as steel grating 106 is also cast into the layer of lightweight reinforced cast refractory 100 so that the cover 90 can be lifted magnetically. It will also be appreciated that the cover shown in FIG. 5 may also be rendered magnetically liftable by similarly casting a steel grating or some other sufficient amount of a ferrous material into the upper layer of dense fiber reinforced castable refractory 78. Alternate manual lifting of cover 90 is facilitated by hook receiving space 108 and bar 110.

It will, therefore, be understood that there has been described a flexible insulating coke oven charging hole cover which may be manufactured quickly and at a relatively low cost. Although the invention has been described with a certain degree of particularity, it is to be understood that the present disclosure has been made only as an example and that the scope of the invention is defined by what is hereafter claimed.

What is claimed is:

1. A coke oven charging hole cover comprising:
(a) a generally cylindrical wall section;
(b) a peripheral lip section outwardly projecting from the upper terminal end of said wall section;
(c) a cast-in-place lower horizontal layer of dense fiber reinforced castable refractory material positioned inside the cylindrical wall section;
(d) a horizontal layer of less dense insulating material positioned inside the cylindrical wall section and superimposed over said layer of dense fiber reinforced refractory material;
(e) a cast-in-place upper horizontal layer of dense fiber reinforced refractory material superimposed over the horizontal layer of less dense insulating material;
(f) metallic radiant heat reflecting means interposed between said layer of less dense insulating material and said upper and lower layers of dense fiber reinforced refractory material;
(g) a wire mesh fixed interiorly to said cylindrial wall section and cast into the lower layer of dense fiber reinforced refractory material so as to retain said layers of dense fiber reinforced refractory material and said layer of less dense insulating material inside said cylindrical wall section; and
(h) ferrous metal material cast into the upper layer of dense fiber reinforced refractory material in a sufficient amount to render the charging hole cover magnetically liftable.

2. The coke oven charging hole cover as recited in claim 1 wherein the dense fiber reinforced castable refractory material is reinforced with fine stainless steel fibers.

3. The coke oven charging hole cover as defined in claim 1 wherein the generally cylindrical wall section has a lower terminal peripheral crimp so as to help retain the layers of dense fiber reinforced refractory material and the layer of less dense insulating material inside said cylindrical wall section.

4. The coke oven charging hole cover as defined in claim 1 wherein the generally cylindrical wall section is tapered downwardly and inwardly so as to help retain the layers of dense fiber reinforced refractory material and the layer of less dense insulating material inside said cylindrical wall section.

5. The coke oven charging hole cover as defined in claim 1 wherein the insulating material is insulation board.

6. The coke oven charging hole cover as defined in claim 1 wherein the insulating material is a cast-in-place lightweight castable refractory material.

7. The coke oven charging hole cover as defined in claim 1 wherein the metallic radiant heat reflecting means is a metal foil.

8. A coke oven charging hole cover comprising:
(a) a generally cylindrical wall section;
(b) a peripheral lip section outwardly projecting from the upper terminal end of said wall section;
(c) a cast-in-place lower horizontal layer of dense fiber reinforced castable refractory material positioned inside the cylindrical wall section;
(d) a cast-in-place upper horizontal layer of lightweight castable refractory material positioned inside the cylindrical wall section and superimposed over said layer of dense fiber reinforced refractory material;
(e) a sufficient amount of a ferrous metal material cast into said upper horizontal layer of castable refractory material to render said coke oven charging hole cover magnetically liftable;
(f) a wire mesh fixed interiorly to said cylindrical wall section and cast into the layer of dense fiber reinforced refractory material so as to retain the layer of dense fiber reinforced refractory material and the layer of lightweight castable refractory material inside said cylindrical wall section; and
(g) metallic radiant heat reflecting means interposed between said lower horizontal layer of dense fiber reinforced refractory material and said upper horizontal layer of lightweight castable refractory material.

9. The coke oven charging hole cover as recited in claim 8 wherein the dense fiber reinforced castable refractory material is reinforced with fine stainless steel fibers.

10. The coke oven charging hole cover as defined in claim 8 wherein the generally cylindrical wall section has a lower terminal peripheral crimp so as to help retain the layer of dense fiber reinforced castable refractory material and the layer of lightweight castable material inside said cylindrical wall section.

11. The coke oven charging hole cover as defined in claim 8 wherein the generally cylindrical wall section is tapered downwardly and inwardly so as to help retain the layer of dense fiber reinforced refractory material and the layer of lightweight castable refractory material inside said cylindrical wall section.

12. The coke oven charging hole cover as defined in claim 8 wherein the metallic radiant heat reflecting means is a metal foil.

* * * * *